US010450157B2

(12) United States Patent
Luedeman

(10) Patent No.: US 10,450,157 B2
(45) Date of Patent: Oct. 22, 2019

(54) STAR WHEEL MOUNTS

(71) Applicant: Hewlett-Packard Development Company, L.P., Houston, TX (US)

(72) Inventor: Timothy J Luedeman, Portland, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/763,515

(22) PCT Filed: Jan. 25, 2016

(86) PCT No.: PCT/US2016/014715

§ 371 (c)(1),
(2) Date: Mar. 27, 2018

(87) PCT Pub. No.: WO2017/131610

PCT Pub. Date: Aug. 3, 2017

(65) Prior Publication Data

US 2018/0282094 A1 Oct. 4, 2018

(51) Int. Cl.
*B65H 29/20* (2006.01)
*B65H 29/12* (2006.01)
(Continued)

(52) U.S. Cl.
CPC ..... *B65H 9/08* (2013.01); *B41J 13/076* (2013.01); *B65H 5/00* (2013.01); *B65H 5/06* (2013.01);
(Continued)

(58) Field of Classification Search
CPC ..... B65H 29/20; B65H 29/12; B65H 29/125; B65H 2404/1115; B65H 2404/1416; B65H 2601/251; B65H 2402/30; B65H 2402/31; B65H 2402/515; B65H 2402/5152; B65H 2402/5153; B65H 2402/521; B65H 2402/60; B65H 2402/63; B65H 2402/631; B65H 5/062; B65H 5/06; B41J 13/106; B41J 13/076; B41J 13/02
See application file for complete search history.

(56) References Cited

U.S. PATENT DOCUMENTS 5,516,222 A 5/1996 Debruin et al.
6,059,287 A 5/2000 Bae
6,554,417 B2 * 4/2003 Lin ..... B41J 13/02 347/104
7,147,223 B2 * 12/2006 Fukuchi ..... B65H 5/062 271/274
(Continued)

FOREIGN PATENT DOCUMENTS

JP 10157885 A * 6/1998
JP 2006096563 4/2006
(Continued)

*Primary Examiner* — Luis A Gonzalez
(74) *Attorney, Agent, or Firm* — HP Inc. Patent Department

(57) ABSTRACT

Examples described herein include a star wheel mount that includes a support element. The support element includes a first clip element coupled to a first end to engage a first mounting element on a media handler housing, and a second clip element coupled to a second end opposite the first end to engage a second mounting element on the media handler housing. The star wheel mount also includes a star wheel support axle coupled to hold a star wheel in a plane perpendicular to a surface of the media handler housing.

12 Claims, 5 Drawing Sheets

(51) Int. Cl.

| | |
|---|---|
| ***B41J 13/076*** | (2006.01) |
| ***B65H 9/08*** | (2006.01) |
| ***B65H 5/06*** | (2006.01) |
| ***B65H 29/52*** | (2006.01) |
| ***B65H 5/00*** | (2006.01) |

(52) U.S. Cl.

CPC ..... *B65H 29/20* (2013.01); *B65H 29/52* (2013.01); *B65H 29/12* (2013.01); *B65H 2301/517* (2013.01); *B65H 2402/30* (2013.01); *B65H 2402/515* (2013.01); *B65H 2402/5153* (2013.01); *B65H 2402/60* (2013.01); *B65H 2404/1115* (2013.01); *B65H 2404/1416* (2013.01); *B65H 2404/61* (2013.01); *B65H 2404/65* (2013.01); *B65H 2601/251* (2013.01); *B65H 2801/24* (2013.01)

(56) References Cited

U.S. PATENT DOCUMENTS

| | | | | |
|---|---|---|---|---|
| 7,641,331 | B2 | 1/2010 | Chen | |
| 7,703,608 | B2 | 4/2010 | Hsu | |
| 8,301,072 | B2 * | 10/2012 | Fukunaga ..... | G03G 15/161 399/121 |
| 2007/0212108 | A1 * | 9/2007 | Hozono ..... | G03G 21/1638 399/121 |
| 2013/0321546 | A1 | 12/2013 | Lo et al. | |
| 2017/0115616 | A1 * | 4/2017 | Suto ..... | B65H 1/04 |

FOREIGN PATENT DOCUMENTS

| | | |
|---|---|---|
| JP | 2008074022 | 4/2008 |
| JP | 2015093756 | 5/2015 |
| KR | 20050115562 | 12/2005 |

* cited by examiner

STAR WHEEL MOUNTS

BACKGROUND

Printing devices include systems for handling print media. Such media handling systems can include devices and mechanisms for selecting and moving raw or unprinted print media and printed print media relative to other components of the printing devices. For example, a media handler can include components for pulling print media, such as paper, from a stack or spool and aligning it in a print zone of a corresponding print engine (e.g., an inkjet print head, a liquid electrophotographic image drum). A media handler can also include components for presenting or exposing printed print media to curing or drying elements for drying, fixing or otherwise finishing a printed image. Such media handlers include various mechanical elements for grabbing, holding, moving, bending, and otherwise manipulating print media through the print media path of the corresponding printing device.

DETAILED DESCRIPTION

Figure 1:
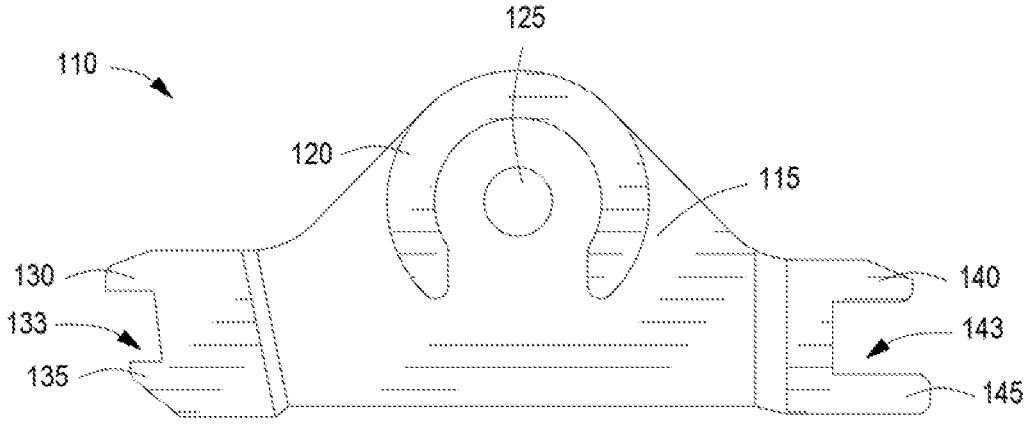
FIG. 1 depicts a schematic representation of an example mounting element.

Print media handling systems in printer devices can include various mechanisms and components for feeding print media pass the various subcomponents of the print system. Such print media handling systems include rollers for moving the unprinted print media into a print zone for application of various printing materials to the print media. In some implementations, once printing materials, such as inks, pigments, or dyes, are applied to the print media, additional steps may be necessary to fix or make the printed image permanent on the print media. For example, some printers include forced hot air dryers to evaporate water or other solvents included in the printing material from the surface of the print media. Other printers use radiant energy, such as infrared and ultraviolet light, to cure the correspondingly sensitive printing materials.

Before being fixed or cured onto the print media, the printing materials may be susceptible to damage or defect due to physical contact with components of the print media handling system. For example, when a printed image formed using multiple colors of ink is still wet on the surface of the print media, rollers, slides, guides, and other physical elements of the media handling system can cause the ink to smudge, smear, scratch, or otherwise be damaged. To help avoid such damage, media handling systems of the present disclosure can include star wheels that hold the printed surface of print media away from components of the printer that might damage the still wet or uncured printed image. The star wheel can achieve this by limiting contact with the surface of the printed print media to very small or sharp elements disposed around circumference of a rotating wheel. By limiting the area to the very small points of contact, the damage caused by contact with the star wheel as the print media moves along or passed can be minimized or eliminated. To ensure that the star wheels do not skip, stutter, or drag through the wet printed image, the star wheels can be disposed and oriented to rotate in a direction corresponding to the media path.

Controlling the orientation of the star wheel can include controlling the physical dimensions of the star wheel idler or axle about which it rotates. In some scenarios, controlling the physical dimensions can include specifying narrower dimensional tolerances on the star wheel idler and other components of the printer to which they are coupled. However, as the print media format capabilities of the printer increases (e.g., the capability of the printer to print on larger physically larger print media), the more difficult it is to control the dimensions of multiple star wheel idler and/or the housing of the print media handler system used to guide the printed media through the print media path. For example, injection molded parts sufficiently wide to support multiple star wheels sufficient to carry wet or uncured printed large format print media are difficult to form with tolerances that can help ensure that the star wheels do not skip, stutter or drag across the surface of the printed media. Various example implementations described here in can be useful in system to help prevent star wheels from skipping, stuttering, or dragging across a wet or uncured printed image in any size or format of printer and/or print media handling system.

FIG. 1 depicts an example star wheel mount 110 that includes various features according of the present disclosure. In example implementations, a media handling system can include various support elements, guides, and traction elements for guiding print media through the printing device. In such implementations, the print media handling system can include a media handler housing that includes placement elements for accepting and holding multiple star wheel mounts 110 and/or star wheel assemblies in an array or configuration to hold a wet or uncured printed media away from other physical elements of the printing device. The star wheel mounts 110 depicted in FIG. 1 is an illustrative of one example of an element that can be used to support the star wheel (not shown) and couple the star wheel to the media handler housing. Depictions of the process of coupling the star wheel mounts 110 to a media handler housing artifact then and described in more detail below in reference to the FIG. 4A through FIG. 5.

As shown in FIG. 1, the star wheel mounts 110 can include various elements for supporting and guiding the star wheel as well as coupling to a media handler housing. In the particular example shown, the star wheel mounts 110 can include a support element 115. The support element 115 can be dimensioned according to the dimensions of a star wheel and/or the receiving regions of a corresponding media handler housing.

To rotatably support a star wheel, star wheel mount 110 can include star wheel support axle 125. In the example shown, the star wheel support axle 125 can be coupled to the support element 115 in an orientation in which the axis is perpendicular to a particular surface of the support element 115. In one example implementation, the star wheel support axle 125 can include a cylindrical element coupled to the support element 115 at one end. The dimensions, such as the length, radius or circumference, of the star wheel support axle 125 can be dimensioned according to the dimensions of a corresponding star wheel or paper handler housing with which it will be used.

In various example implementations, the star wheel mount 110 can also include a star wheel guide element 120. As shown in FIG. 1, the star wheel guide element 120 can include a curved wall element disposed around the star wheel support axle 125 to provide support to a corresponding star wheel along a surface at a radius greater than the radius of the star wheel support axle 125. As such, the star wheel guide element 120 can stabilize the rotation of the star wheel as it rotates about the star wheel support axle 125. The example star wheel guide element 120 is depicted as a curved wall of a particular thickness that has a circular profile concentric with the star wheel support axle 125. Other implementations the present disclosure can include star wheel guide elements 120 that have different shapes, thicknesses, profiles or configurations. For example, the star wheel guide element 120 may also include a rectangular profile and/or individual standoff pillar elements that only make contact with the star wheel at various locations. Such implementations can improve the rotation of the star wheel about the star wheel support axle 125 by reducing the surface area of contact and, thus, reduce the friction between the star wheel and the star wheel guide element 120.

The star wheel mounts 110 may also include various integrated catch elements for coupling with a corresponding media handler housing. In the example shown in FIG. 1, the star wheel mount 110 can include an integrated catch element for coupling to a media handler housing. In particular, the integrated catch element can include multiple dip elements. For example, one implementation of the integrated catch element can include one clip element coupled to one side of the support element 115 and another clip element coupled to another side of the support element 115. One of the clip elements can include a top element 140 and a bottom element 145 coupled to the support element 115 and disposed relative to one another to define a catch region 143. Another the dip element can include another top element 130 and another bottom element 135 coupled to the support element 115 and disposed relative to one another to define a catch region 133. The catch regions 133 and 143 can be dimensioned according to the corresponding catch elements integrated into the surface of the corresponding paper handler housing. In some implementations, the bottom element 135 can include a one-way catch functionality so that the star wheel mount 110 can be snapped securely into the corresponding catch elements of the paper handler housing. Any or all of the elements of the star wheel mount can be formed as a single integrate part using various milling or molding processes (e.g., injection molding).

Figure 2A:
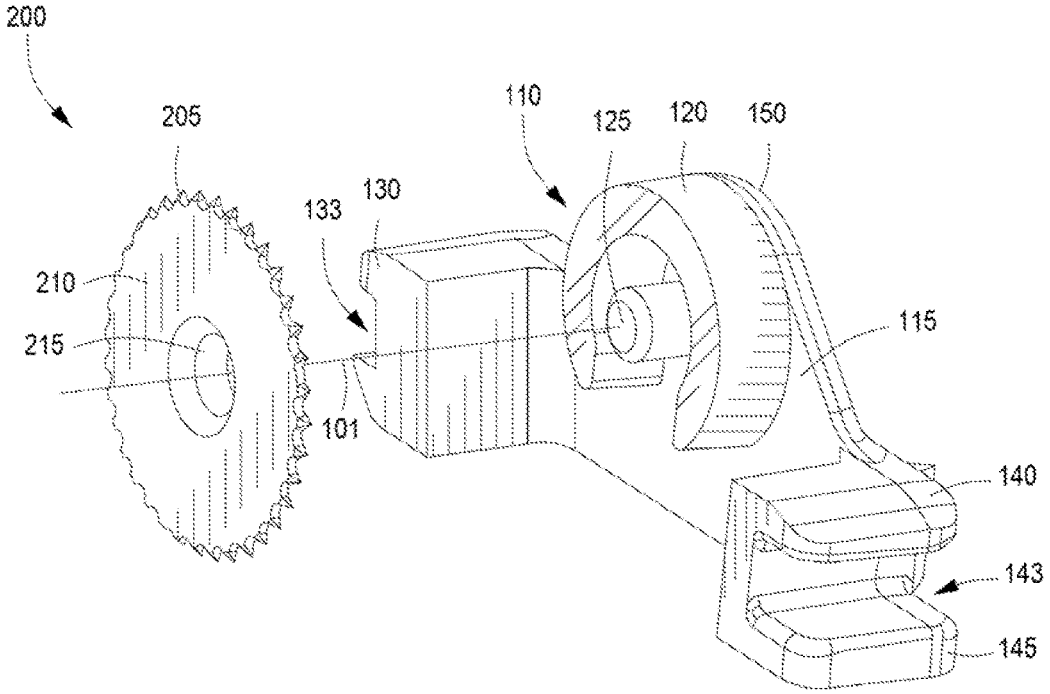
FIG. 2A depicts a perspective view of an example star wheel mounting assembly.
Figure 2B:
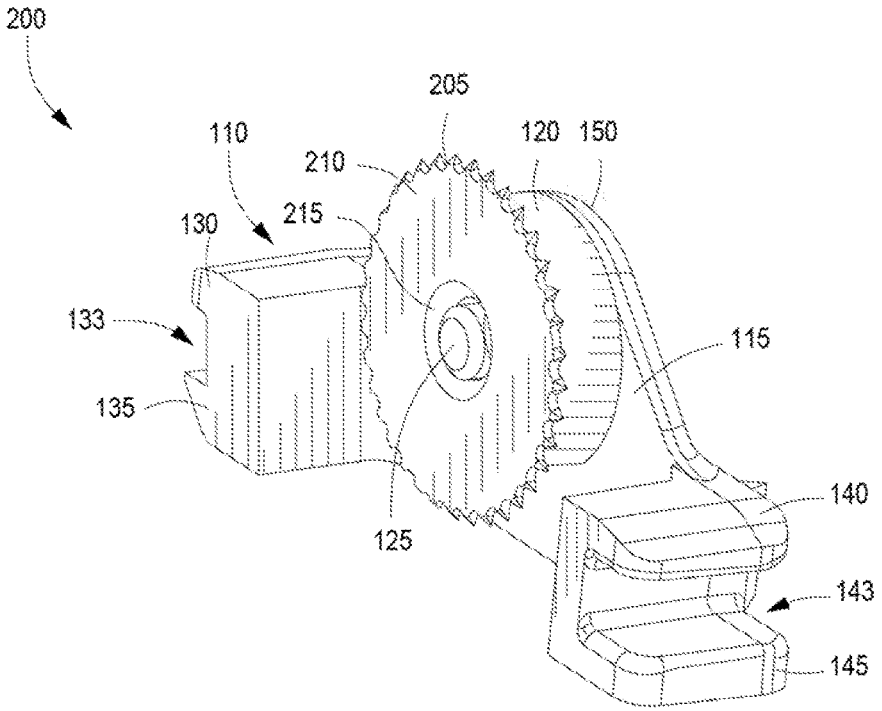
FIG. 2B depicts a perspective view of an example star wheel mounting assembly.

FIG. 2A shows a perspective view an unassembled star wheel assembly 200 that includes a star wheel 210 and a star wheel mount 110. FIG. 2B shows a perspective view of an assembled star wheel assembly 200. Specifically, FIG. 2B depicts the placement of the star wheel 210 on the star wheel support axle 125. In such implementations, the star wheel 210 can be concentric with the star wheel support axle 125 having an axis 101.

The star wheel 210 can include a mounting element 215 and a plurality of teeth 205 disposed around the circumference. In the particular example illustrated in FIG. 2A, the star wheel 210 can have a annular body. The thickness and material of the annular body can be selected to achieve the desired rigidity and ability to hold a sharp point on the teeth 205.

In various example implementations, the mounting element 215 of the star wheel 210 can include a center hole dimensioned to fit around the star wheel support axle 125. In the particular example shown FIGS. 2A and 2B, the mounting element 215 can include a center hole having an inner wall and an opening with a radius that allows the star wheel 210 to rotate about the star wheel support axle 125. In some implementations, the mounting element 215 can be formed by stamping a metal blank before or after the star wheel teeth 205 are formed.

In some implementations, the support element 115 can include the top surface 150 that has a circular or rounded profile. The circular or rounded profile the top surface 150 can be concentric with the star wheel support axle 125 and dimensioned so that the teeth 205 of the star wheel 210 extend beyond the top surface 150 by a particular distance corresponding to the dimensions of the teeth and/or the radius of the star wheel 210.

Figure 3:
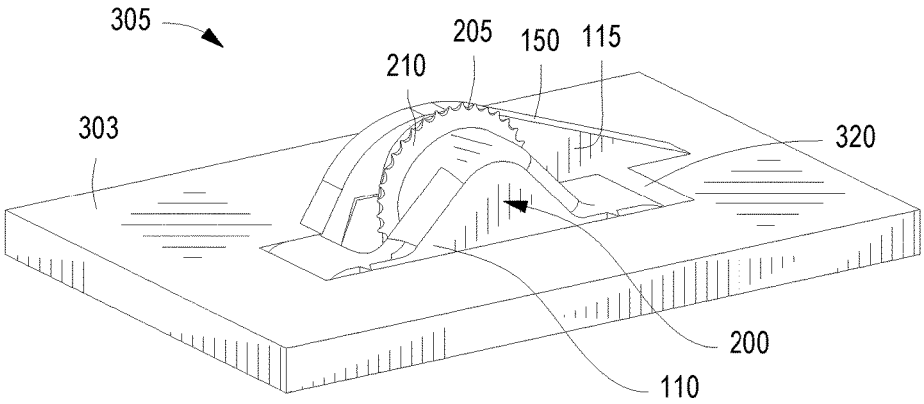
FIG. 3 depicts a perspective view of an example star wheel mounting assembly in a parent mounting element.

FIG. 3 depicts a perspective view of assembly 305 that includes a star wheel assembly 200 and a media handler housing 303. As shown in FIG. 3, the media handler housing 303 can represent a section of a larger media handler housing (e.g., a media handling system can include many additional sections similar to the media handler housing 303). As illustrated, the star wheel assembly 200 can include components identical or similar to the components described above in reference to FIGS. 2A and 2B. Accordingly, the star wheel assembly 200 can be coupled to the media handler housing 303 by connecting catch elements of the star wheel mount 110 with corresponding catch elements in the recessed region 320.

Figure 4A:
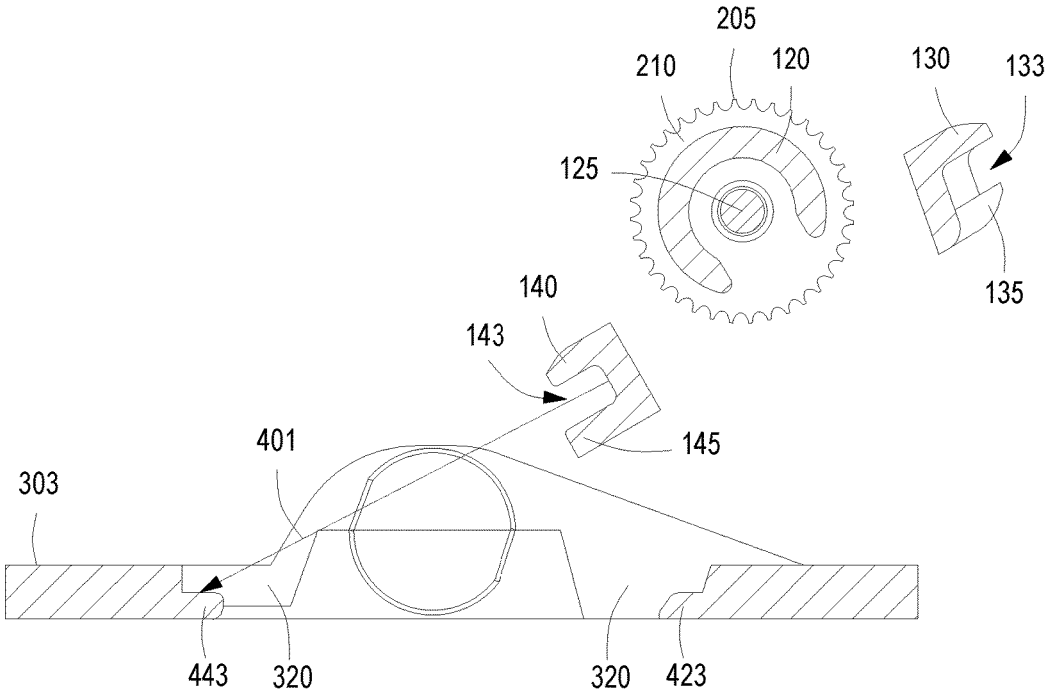
FIG. 4A depicts a step in assembling an example star wheel mounting assembly.
Figure 4B:
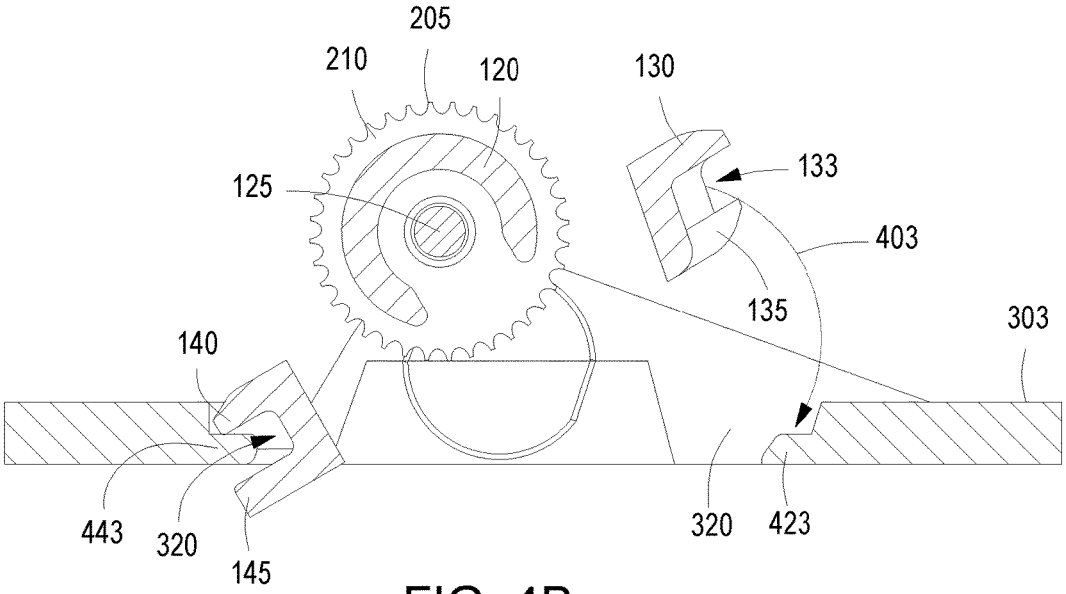
FIG. 4B depicts a step in assembling an example star wheel mounting assembly.
Figure 4C:
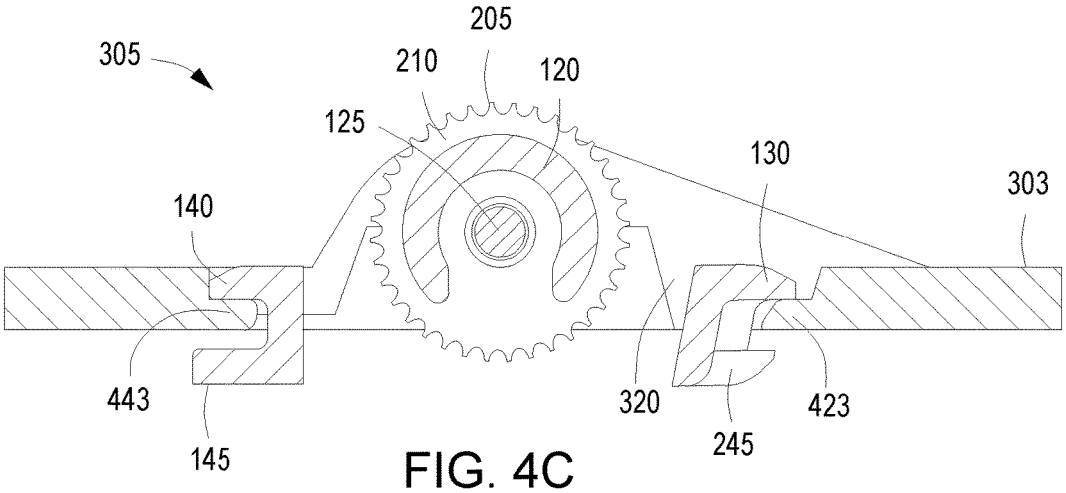
FIG. 4C depicts a step in assembling an example star wheel mounting assembly.

To further illustrate the coupling of the various catch elements according to various example implementations of the present disclosure, FIGS. 4A through 4C show various stages of coupling the star wheel assembly 200 with the media handler housing 303. For clarity sake, some of the elements of star wheel mount 110 are omitted from FIGS. 4A through 4C.

As shown in FIG. 4A, the star wheel assembly can be positioned relative to the media handler housing 303 so that a first end is positioned toward integrated catch element 443 in the recessed region 320. As shown, the angle of the star wheel assembly 200 can be chosen to allow the integrated catch element 443 to be disposed in the catch region 143 between the upper element 140 and the lower the element 145 by moving along the direction indicated by arrow 401. FIG. 4B depicts the star wheel assembly 200 positioned so that the integrated catch element 443 is disposed in the catch region 143.

With the integrated catch element 443 disposed in the catch region 143, the star wheel assembly 200 can be rotated in the direction indicated by arrow 403 to push the lower catch element 135 pass the integrated catch element 423 in the recessed region 320 of the media handler housing 303. As described herein, the lower catch element 135 can include a one-way catch element that snaps into position once pushed past the integrated catch elements 423 in the media handler housing 300. When in position, the integrated catch element 423 can be disposed in the region 133 between the upper catch element 130 and the lower catch element 135. FIG. 4C depicts a side view of the completed assembly 305 in which the star wheel assembly 200 is securely coupled to the media handler housing 303 by the catch elements 140, 145, 130, and 135 and the corresponding integrated catch elements 443 and 423.

Figure 5:
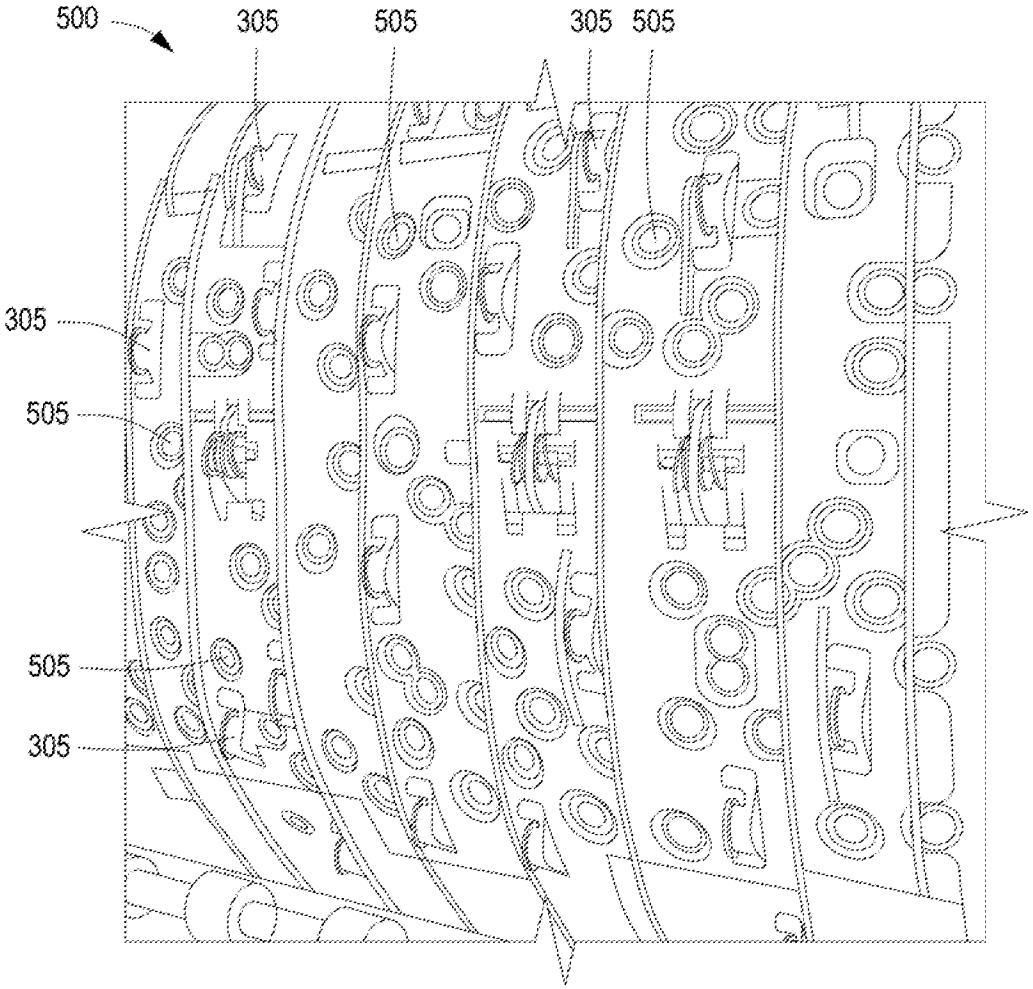
FIG. 5 depicts a dryer mechanism including multiple example star wheel mounting assemblies.

FIG. 5 depicts an image of media handling system 500 that includes multiple assemblies 305. In the example shown, the section of the media handling system 500 can include a folded drying region that includes multiple warm or hot air nozzles 505 in the larger media handler housing. In this particular example, the star wheels 210 allow print media, such as paper, to move along the surface of the media handling system 505 to be dried by the air output at the nozzles 505 without damaging the printed image. In effect, the star wheels provide a standoff between any of the other physical elements of the media handler system 500.

According to various implementations of the present disclosure, the inclusion of the multiple assemblies 305 into the media handling 500 allows for low costs, efficient, and fast manufacturing using various moldable materials and injection molding processes with dimensional tolerances sufficient to avoid damaging wet or uncured printed materials due to skipping, stuttering, or dragging of the star wheels 210. In particular, the dimensional tolerances of the star wheel mounts 110 can be sufficient to rigidly and accurately dispose the star wheel 210 in alignment with the print media path so as to prevent skipping, stuttering, or dragging of the star wheel across the printed image. The dimensional tolerances of the star wheel mounts 110 can be narrower or tighter than the dimensional tolerances used for forming the injection molded large media handler housing or media handler housing 303. By allowing for looser dimensional tolerances in the injection molding process to form the media handler housing, yield can be increased while also decreasing costs in the manufacturing process. The tighter dimensional tolerances of the star wheel mounts 110 can be defined according to an/or to compensate for the dimensional tolerances of the media handler housing.

These and other variations, modifications, additions, and improvements may fall within the scope of the appended claims(s). As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise. All of the features disclosed in this specification (including any accompanying claims, abstract and drawings), and/or all of the elements of any method or process so disclosed, may be combined in any combination, except combinations where at least some of such features and/or elements are mutually exclusive.

What is claimed is:

1. A star wheel mount comprising:

a support element;

a first clip element coupled to a first end of the support element to engage a first mounting element on a media handler housing;

a second clip element coupled to a second end of the support element opposite the first end of the support element to engage a second mounting element on the media handler housing;

a star wheel support axle coupled to the support element to hold a star wheel in a plane perpendicular to a surface of the media handler housing; and a star wheel guide element coupled to the support element around the star wheel support axle to guide the star wheel into the plane, the star wheel guide element having a curved wall forming a recess around the star wheel support axle.

2. The star wheel mount of claim 1 wherein the star wheel guide element is dimensioned to allow the star wheel to rotate about the star wheel support axle.

3. The star wheel mount of claim 1 wherein the support element, the first clip element, the second clip element, the star wheel support axle, and the star wheel guide element compose an integrated injection molded part.

4. The star wheel mount of claim 3 wherein the integrated injection molded part is dimensioned according to a first set of dimensional tolerances narrower than a second set of dimensional tolerances associated with the media handler housing.

5. The star wheel mount of claim 1 wherein the star wheel guide element is dimensioned to dispose teeth of the star wheel past an outer surface of the star wheel guide element.

6. The star wheel mount of claim 1 wherein the first clip comprises a one-way catch.

7. An apparatus comprising:

a media handler housing having an exterior surface comprising a recessed region having an integrated catch element; and a star wheel assembly disposed in the recessed region and coupled to the media handler housing at the integrated catch element, wherein the star wheel assembly comprises:

a support element;

a first clip element coupled to a first end of the support element to engage the integrated catch element;

a second clip element coupled to a second end of the support element opposite the first end of the support element to engage integrated catch element;

a star wheel support axle coupled to the support element;

a star wheel mounted about the star wheel support axle; and a star wheel guide element coupled to the support element around the star wheel support axle to guide the star wheel to rotate in a plane perpendicular to the exterior surface, the star wheel guide element having a curved wall forming a recess around the star wheel support axle.

8. The apparatus of claim 7 wherein the media handler is associated with a print media path, and the plane in which the star wheel rotates is parallel to the print media path.

9. The apparatus of claim 7 wherein the support element, the first clip element, the second clip element, the star wheel support axle, and the star wheel guide element comprise a first integrated injection molded element, and the media handler housing comprises a second integrated injection molded element.

10. The apparatus of claim 9 wherein the first integrated injection molded element is dimensioned according to a first set of dimensional tolerances narrower than a second set of dimensional tolerances associated with the second integrated injection molded element.

11. An apparatus comprising:

a media handler housing having an exterior surface comprising a plurality of recessed regions comprising a plurality of corresponding integrated catch elements; and a plurality of star wheel assemblies, each star wheel assembly in the plurality of star wheel assemblies disposed in a corresponding recessed region in the plurality of recessed regions and coupled to the media handler housing by a corresponding integrated catch element in the plurality of corresponding integrated catch elements, wherein each star wheel assembly in the plurality of star wheel assemblies comprises:

a support element;

a first clip element coupled to a first end of the support element to engage the integrated catch element;

a second clip element coupled to a second end of the support element opposite the first end of the support element to engage the integrated catch element;

a star wheel support axle coupled to the support element;

a star wheel mounted about the star wheel support axle; and a star wheel guide element coupled to the support element around the star wheel support axle to guide the star wheel to rotate in a plane perpendicular to the exterior surface, the star wheel guide element having a curved wall forming a recess around the star wheel support axle.

12. The apparatus of claim 11, wherein the star wheel assembly is dimensioned according to a first set of dimensional tolerances narrower than a second set of dimensional tolerances associated with the media handler.

* * * * *